US007479601B1

(12) United States Patent
Cases et al.

(10) Patent No.: US 7,479,601 B1
(45) Date of Patent: Jan. 20, 2009

(54) HIGH-SPEED CABLE HAVING INCREASED CURRENT RETURN UNIFORMITY AND METHOD OF MAKING SAME

(75) Inventors: Moises Cases, Austin, TX (US); Bhyrav M. Mutnury, Austin, TX (US); Bruce J. Wilkie, Georgetown, TX (US); Daniel N. de Araujo, Cedar Park, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/115,586

(22) Filed: May 6, 2008

(51) Int. Cl.
*H01B 9/02* (2006.01)

(52) U.S. Cl. ..... 174/102 R; 174/106 R; 174/113 R

(58) Field of Classification Search ..... 174/102 R, 174/102 SP, 113 R
See application file for complete search history.

(56) References Cited

U.S. PATENT DOCUMENTS 6,288,339 B1 * 9/2001 Efraimsson et al. ..... 174/102 R
6,849,799 B2 2/2005 Springer et al.
2001/0032732 A1 10/2001 Fujino et al.
2006/0254805 A1 11/2006 Scherer et al.

* cited by examiner

*Primary Examiner*—Chau N Nguyen
(74) *Attorney, Agent, or Firm*—Cantor Colburn LLP; Cynthia Byrd

(57) ABSTRACT

A Twinax cable include a first axial cable having an inner diameter portion and an outer diameter portion and including a conductor surrounded by a dielectric material. A second axial cable has an inner diameter portion and an outer diameter portion and including a conductor surrounded by a dielectric material, the second axial cable being arranged such that a portion of the inner diameter thereof contacts the inner diameter portion of the first axial cable. A drain conductor is disposed between at least a portion of the inner diameter portion of the first axial cable and the inner diameter portion of the second axial cable. In addition, the a first foil layer contacts at least a portion of the outer diameter portion of the first axial cable and a second foil layer contacts at least a portion of the outer diameter portion of the second axial cable. An outer foil layer surrounds the first ax cable, the second axial cable, the first foil layer and the second foil layer.

2 Claims, 4 Drawing Sheets

HIGH-SPEED CABLE HAVING INCREASED CURRENT RETURN UNIFORMITY AND METHOD OF MAKING SAME

BACKGROUND OF THE INVENTION

1. Field of the Invention

This invention relates to cables and, in particular, high speed electronic cables.

2. Description of the Related Art

Twinax cable is a cable specified for the IBM 5250 terminals and printers used with IBM's current midrange hosts. With Twinax seven devices can be addressed, from workstation address 0 to 6. The devices do not have to be sequential. These cables work well for their intended purposes.

Twinax was designed by IBM as a replacement for RS-232 dumb terminals. Its main advantages were high speed (1 Mbit/s versus 9600 bit/s) and multiple addressable devices per connection.

Minimizing signal attenuation is Twinax cables has become more and more important with the ever increasing need for high-speed transmission. There exists a need, therefore, to reduce the amount of signal attenuation in Twinax cables.

SUMMARY OF THE INVENTION

One embodiment of the present invention is directed to a cable including a first axial cable having an inner diameter portion and an outer diameter portion and including a conductor surrounded by a dielectric material. The cable of this embodiment also includes a second axial cable having an inner diameter portion and an outer diameter portion and including a conductor surrounded by a dielectric material, the second axial cable being arranged such that a portion of the inner diameter thereof contacts the inner diameter portion of the first axial cable. The cable of this embodiment also includes a drain conductor disposed between at least a portion of the inner diameter portion of the first axial cable and the inner diameter portion of the second axial cable. In addition, the cable of this embodiment also includes a first foil layer contacting at least a portion of the outer diameter portion of the first axial cable and a second foil layer contacting at least a portion of the outer diameter portion of the second axial cable. In this embodiment, the first axial cable does not contact the second axial cable. The cable of this embodiment also includes an outer foil layer which surrounds the first axial cable, the second axial cable, the first foil layer and the second foil layer.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Signal attenuation in Twinax cables may result from a number of factors such as dielectric loss, skin effect, conductor loss and radiation. In high-speed shielded cables, skin effect is a major contributor to attenuation at high frequencies. The skin effect may be predicted, however, the loss due to an improper current return path may create a bottle neck for high-speed shielded cables. In particular, it has been discovered that a current path discontinuity may exist at one or more locations along a Twinax cable where the outer foil wrapping overlaps itself.

Figure 1:
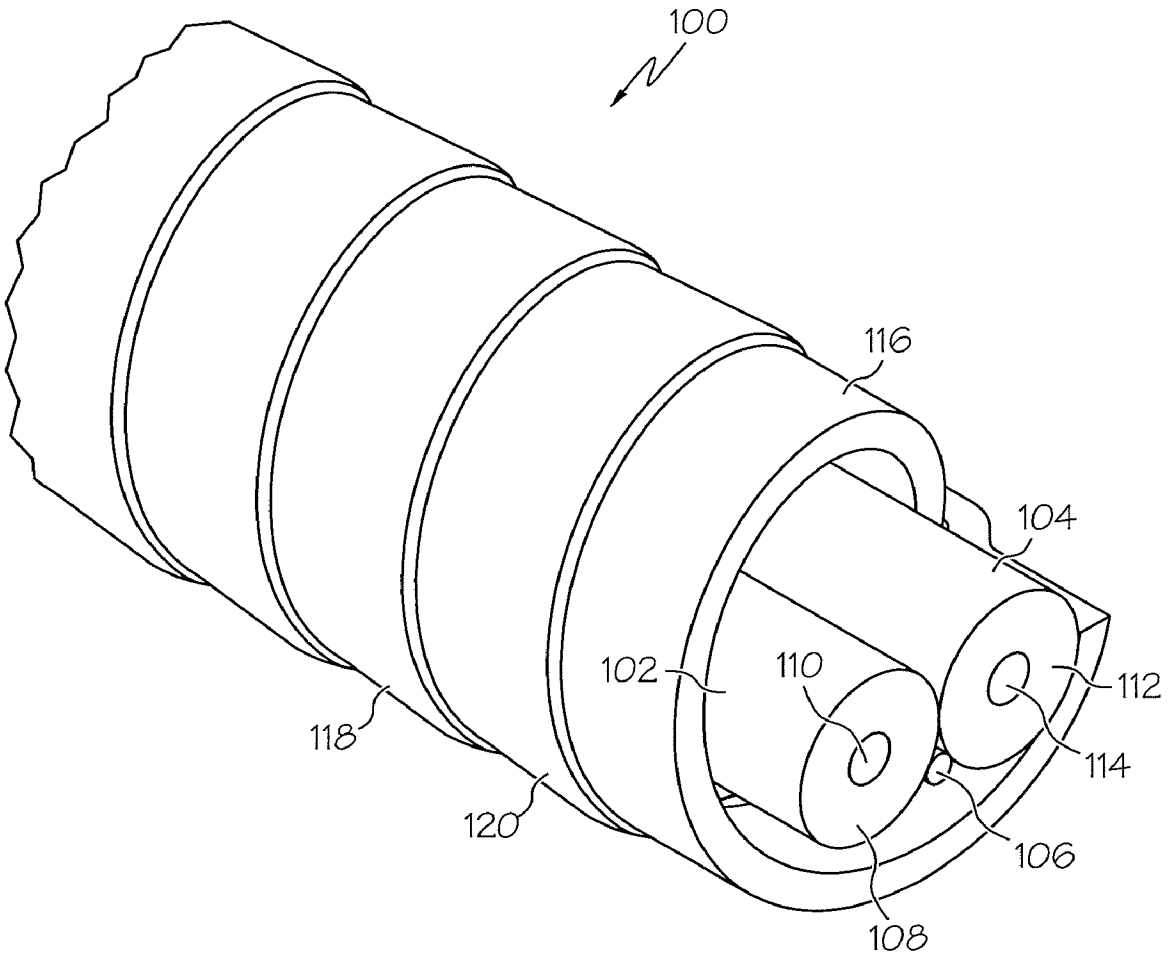
FIG. 1 (PRIOR ART)
FIG. 1 is a perspective view of a prior art Twinax cable.

FIG. 1 shows an example of a conventional Twinax cable 100. The Twinax cable 100 includes two axial cables, a first axial cable 102 and a second axial cable 104. The first axial cable 102 includes a conductor 110 and a dielectric 108 which surround the conductor 110. The second axial cable 104, likewise, includes a conductor 114 surrounded by a dielectric 112. In some embodiments, the conductors 110 and 114 may be made of a metal such as, for example, copper. Each axial cable 102 and 104 is configured to carry an information signal. Of course, in some embodiments, the dielectrics 108 and 112 may not be separate elements and may be connected to one another.

The Twinax cable of FIG. 1 also includes a drain conductor 106. The drain conductor 106. The drain conductor acts as a neutral or ground for the Twinax cable. In some embodiments, the drain conductor may be omitted. In some embodiments, the drain conductor 106 may be disposed so that it is between portions of the first axial cable 102 and the second axial cable 104.

The first axial cable 102, the second axial cable 104 and the drain conductor 106 are all surrounded by an outer foil layer 116. The outer foil layer 116 may be spirally twisted around the other elements in the manner shown in FIG. 1.

It has been discovered that locations where the outer foil 116 overlaps itself are locations where discontinuities in the current path may exist. In FIG. 1, examples of such discontinuity locations are indicated by reference numerals 118 and 120. Of course, other such locations could exist.

It has been discovered that discontinuities in the current return path may result in a resonance and, thus, affect signal attenuation in a Twinax cable.

Figure 2:
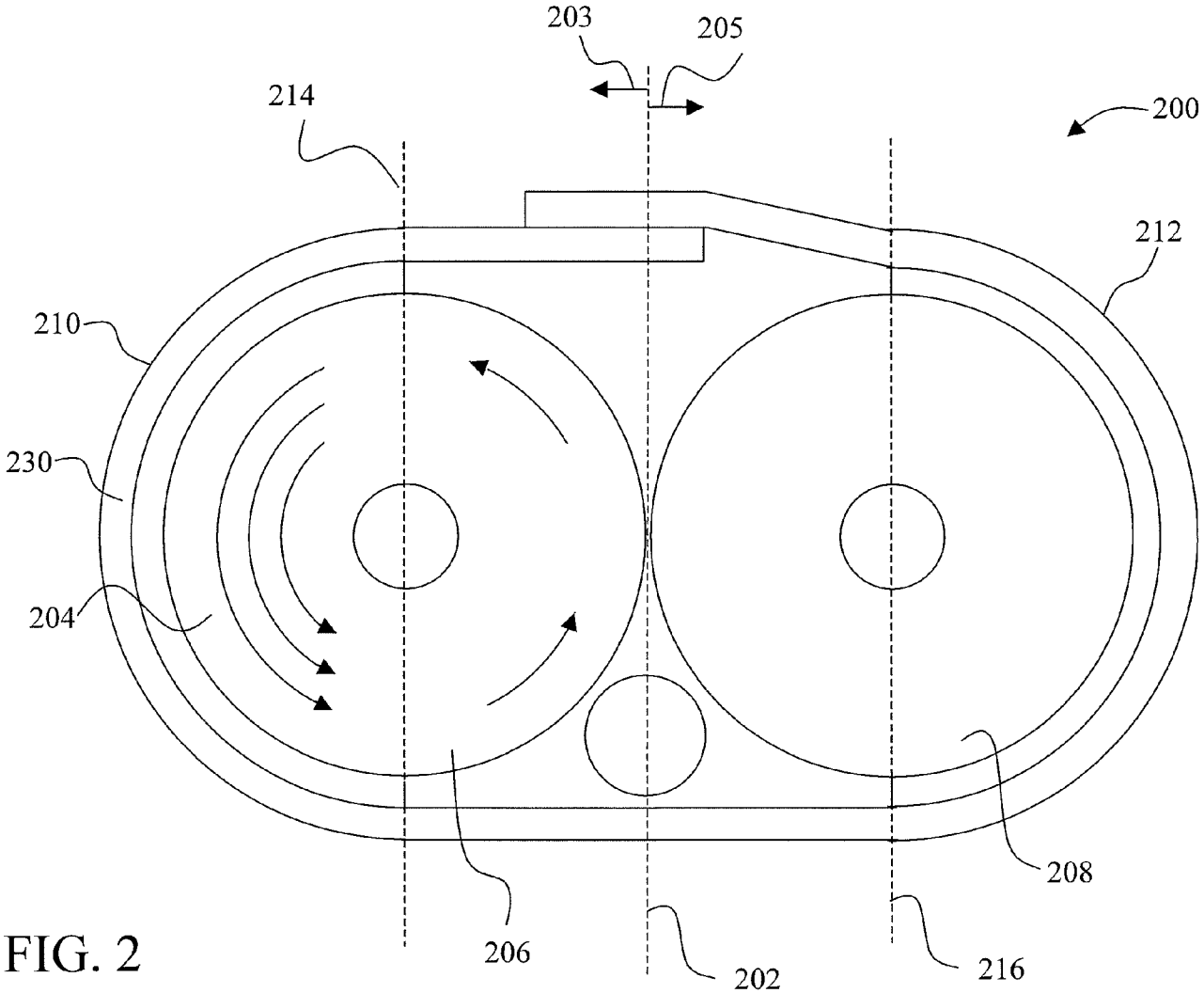
FIG. 2 (PRIOR ART)
FIG. 2 is a cross-sectional view of a prior art Twinax cable including electric field lines.

FIG. 2 shows a cross-sectional view of another conventional Twinax cable 200. The Twinax cable 200 is shown having a vertical centerline 202. The center line 202 divides the Twinax cable into two portions, the first portion 203 includes the first axial cable 210 and the second portion 205 includes the second axial cable 212.

The first axial cable 210 is shown having an outer diameter portion 204 and an inner diameter portion 206. The outer diameter portion 204 of the first axial cable 210 is to the left of a first axial vertical centerline 214. The inner diameter portion 206 of the first axial cable 210 is to the right of the first axial vertical centerline 214.

Similarly, the second axial cable 212 is shown having an outer diameter portion 208 and an inner diameter portion 211. The outer diameter portion 208 of the second axial cable 212 is to the right of a second axial vertical centerline 216. The inner diameter portion 211 of the second axial cable 212 is to the left of the second axial vertical centerline 216.

It has been discovered that the return current traveling in the outer foil 230 is stronger in locations that contact the outer diameter portions 208 and 204 than in foil that does not contact the outer diameter portion, i.e. the portion of the foil between the first and second axial centerlines, 214 and 216, respectively. This disparity in current becomes important when an overlap in the outer foil 230 occurs in a location that contacts one of the outer diameters 208 or 204. This discovery has created a need to provide a current return path that is without discontinuities over at least a portion of the outer diameter of the axial cables within a Twinax cable.

Aspects of the present invention are directed to ensuring uniform current return at regions of a Twinax cable where there is strong current distribution (i.e., the outer diameter portions the first and second axial cables). Because the strong current distribution region is confined to the outer diameter portions, conductive foils having a width equal to or less than half the diameter of a particular axial cable may be disposed along the length of the axial cable along the outer diameter of the axial cable. Each axial cable may be so covered. The entire package may then be wrapped with a conventional shielded foil. This may help reduce the effect of outer foil overlap on the outer diameters of the axial cables.

Figure 3:
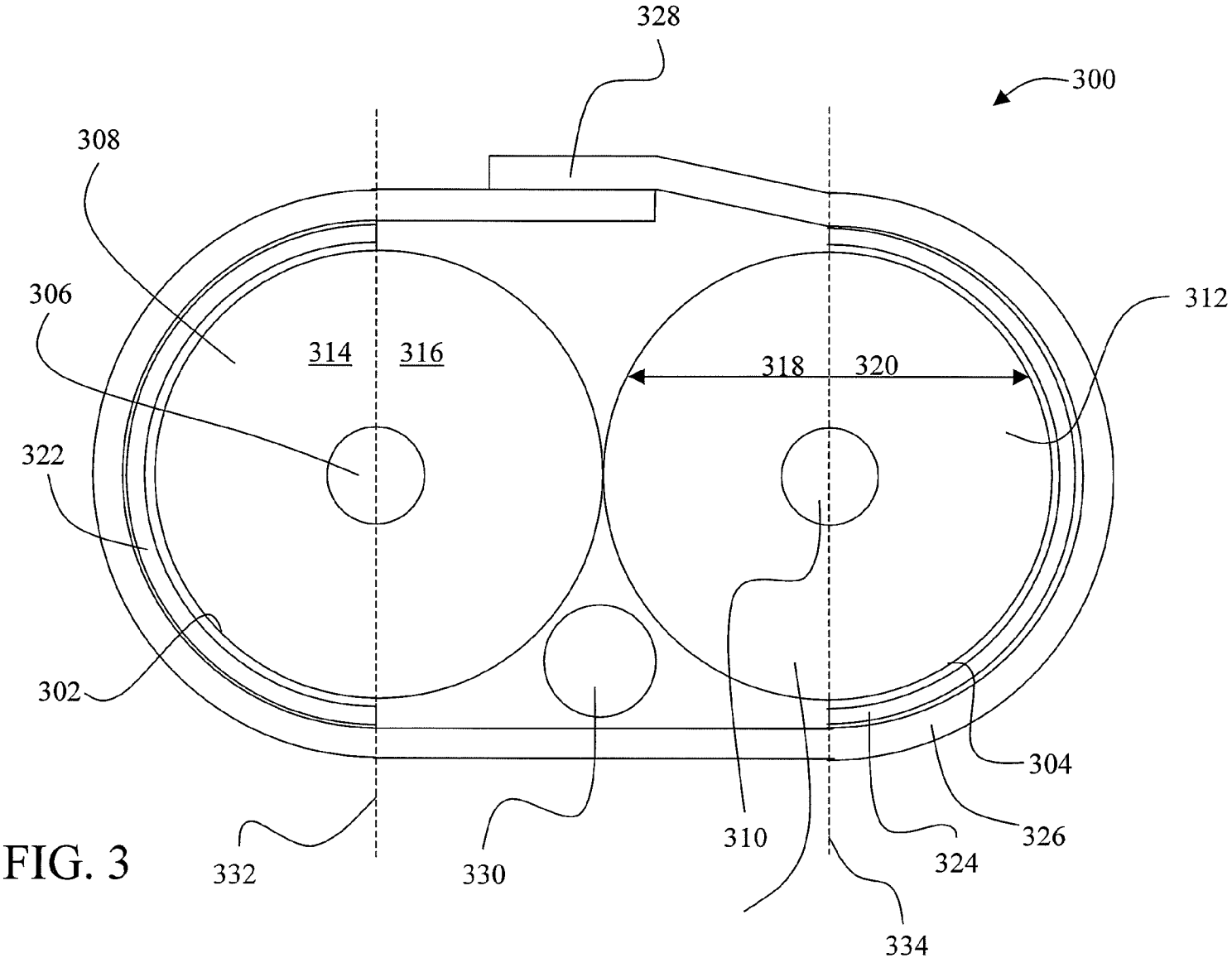
FIG. 3 is a cross-sectional view of a cable according to an embodiment of the present invention.

FIG. 3 shows a cross sectional view of a cable 300 according to an embodiment of the present invention. The cable 300 includes a first axial cable 302 and a second axial cable 304. The first axial cable 302 includes a conductor 306 surrounded by a dielectric 308. The second axial cable 304 includes a conductor 310 surrounded by a dielectric 312.

The first axial cable 302 is shown having an outer diameter portion 314 and an inner diameter portion 316. The outer diameter portion 314 of the first axial cable 302 is to the left of a first axial vertical centerline 332. The inner diameter portion 316 of the first axial cable 302 is to the right of the first axial vertical centerline 332.

Similarly, the second axial cable 304 is shown having an outer diameter portion 320 and an inner diameter portion 318. The outer diameter portion 320 of the second axial cable 304 is to the right of a second axial vertical centerline 334. The inner diameter portion 318 of the second axial cable 304 is to the left of the second axial vertical centerline 334. As shown, a portion of the inner diameter 318 of the second acial cable 304 contacts the inner diameter portion 316 of the first axial cable 302.

The cable 300 also includes a first foil layer 322 and a second foil layer 324 that may be smooth and non-corrugated. The first foil layer 322 is disposed such that it contacts at least a portion of the outer diameter portion 314 of the first axial cable 302. In some embodiments, the first foil layer 322 does not contact any portion of the inner diameter portion 316 of the first axial cable 302. In some embodiments, the first foil layer 322 extends to the inner diameter portion of the first or second axial cables. In some embodiments, the first foil layer 322 does not contact all of the outer diameter portion 314 of the first axial cable 302.

The second foil layer 324 is disposed such that it contacts at least a portion of the outer diameter portion 320 of the second axial cable 304. In some embodiments, the second foil layer 320 does not contact any portion of the inner diameter portion 318 of the second axial cable 304. In some embodiments, the second foil layer 324 extends to the inner diameter portion of the first or second axial cables. In some embodiments, the second foil layer 324 does not contact all of the outer diameter portion 314 of the second axial cable 304. In some embodiments, the second foil layer 324 does not contact the first foil layer 322.

The cable 300 may also include a drain conductor 330. The drain conductor 330 may be disposed between at least a portion of the inner diameter portions 316 and 318 of the first and second axial cables, 302 and 304, respectively. Of course, the drain conductor 330 could be disposed in other locations.

The first axial cable 302, the second axial cable 304, the first foil layer 322, the second foil layer 324 and the drain conductor 330 may all be surrounded by the an outer foil layer 326. In some embodiments, portions for of the outer foil layer 326 may overlap one another as indicted by reference numeral 328.

Figure 4:
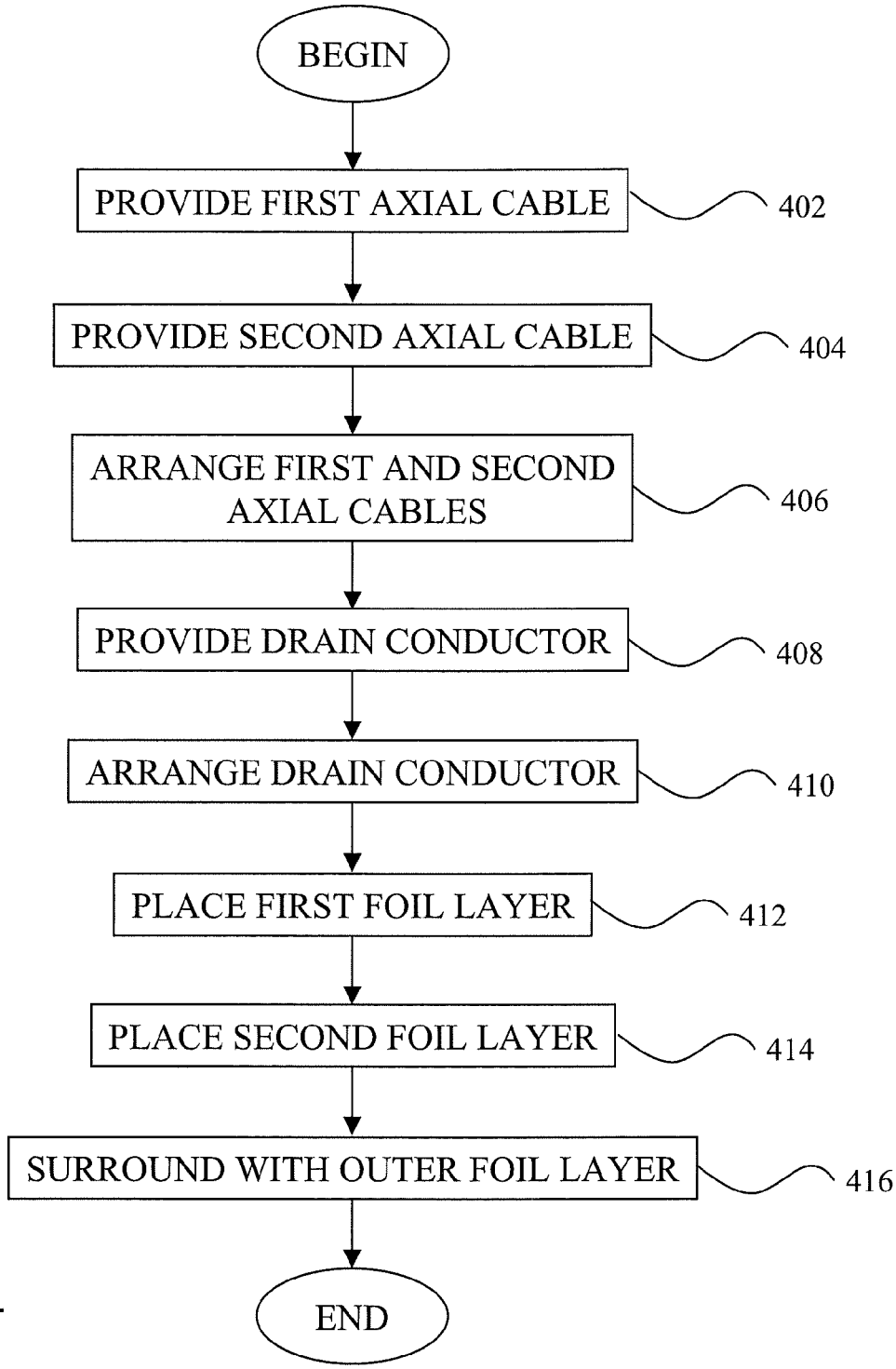
FIG. 4 is a block diagram of a method by which a cable according to an embodiment of the present invention may be created.

FIG. 4 is a flow diagram of how a cable according to the present invention may be formed. The method includes a block 402 where a first axial cable having an inner diameter portion and an outer diameter portion and including a conductor surrounded by a dielectric material is provided. At a block 404, a second axial cable having an inner diameter portion and an outer diameter portion and including a conductor surrounded by a dielectric material is provided.

The method also includes a block 406 where the first and second axial cables are arranged relative to one another such that a portion of the inner diameter of the second axial cable contacts a portion of the inner diameter portion of the first axial cable. The method also includes a block 408 where a drain conductor is provided. The method also includes a block 410 where the drain conductor is arranged such that it is located between at least a portion of the inner diameter of the first axial cable and the inner diameter of the second axial cable.

The method also includes a block 412 where a first foil layer is placed on the first axial cable such that it contacts at least a portion of the outer diameter of the first axial cable and a block 414 where a second foil layer is placed on the second axial cable such that it contacts at least a portion of the outer diameter of the second axial cable. In some embodiments, the first and second foil layers, respectively, are placed along an entire length of the first and second axial cables. In other embodiments, the first and second foil layers may only be placed along only a portion of the length, respectively, of the first and second axial cables. All that is required is that the first and second foil layers are placed on some portion of the length of the Twinax cable.

Finally, the method includes a block 416 wherein the first axial cable, the second axial cabe, the drain conductor, the first foil layer and the second foil layer are all surrounded with an outer foil layer. This foil layer may, in some embodiments, be spirally wrapped around other elements that had previously been provided and arranged.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A cable comprising:

a first axial cable having an inner diameter portion and an outer diameter portion and including a conductor surrounded by a dielectric material;

a second axial cable having an inner diameter portion and an outer diameter portion and including a conductor surrounded by a dielectric material, the second axial cable being arranged such that a portion of the inner diameter thereof contacts the inner diameter portion of the first axial cable;

a drain conductor disposed between at least a portion of the inner diameter portion of the first axial cable and the inner diameter portion of the second axial cable;

a first smooth and non-currogated foil layer contacting at least a portion of the outer diameter portion of the first axial cable;

a second smooth and non-currogated foil layer contacting at least a portion of the outer diameter portion of the second axial cable; and a metal outer foil layer which surrounds the first axial cable, the second axial cable, the first foil layer and the second foil layer;

wherein the first foil layer does not contact the second foil layer.

2. The cable of claim 1, wherein the first foil layer does not contact the inner diameter portion of the first axial cable and the second foil layer does not contact the inner diameter portion of the second axial cable.

* * * * *